United States Patent [19]

Yamaguchi

[11] Patent Number: 5,053,146

[45] Date of Patent: Oct. 1, 1991

[54] METHOD FOR EXTINGUISHMENT OF METAL FIRE AND FIRE EXTINGUISHING AGENT THEREFOR

[75] Inventor: Hisayoshi Yamaguchi, Tokyo, Japan

[73] Assignee: Shin-Etsu Handotai Co., Ltd., Tokyo, Japan

[21] Appl. No.: 513,906

[22] Filed: Apr. 24, 1990

[30] Foreign Application Priority Data

Apr. 27, 1989 [JP] Japan ..... 1-108110

[51] Int. Cl.[5] ..... A62D 1/00

[52] U.S. Cl. ..... 252/2; 252/8; 169/44; 169/46

[58] Field of Search ..... 252/2, 8; 169/46, 44

[56] References Cited

U.S. PATENT DOCUMENTS

| | | | |
|---|---|---|---|
| 3,055,435 | 9/1962 | Warnock et al. | 169/31 |
| 3,393,155 | 7/1968 | Schutte et al. | 252/316 |
| 4,830,762 | 5/1989 | Yamaguchi et al. | 252/2 |
| 4,838,946 | 6/1989 | Yamaguchi et al. | 134/7 |
| 4,879,050 | 11/1989 | Yamaguchi et al. | 252/2 |
| 4,915,853 | 4/1990 | Yamaguchi | 252/2 |

FOREIGN PATENT DOCUMENTS

| | | |
|---|---|---|
| 0323350 | 7/1989 | European Pat. Off. . |
| 3830122 | 3/1989 | Fed. Rep. of Germany . |
| 1063207 | 3/1967 | United Kingdom . |

*Primary Examiner*—Robert L. Stoll
*Assistant Examiner*—Nina Bhat
*Attorney, Agent, or Firm*—McAulay Fisher Nissen Goldberg & Kiel

[57] ABSTRACT

An efficient fire extinguishing agent is proposed which is suitable for extinguishing fire of a burning metal such as a magnesium powder and used, for example, as a filling of fire extinguishers with stability over a long period of time for storage without decreasing the flowability and ejectability from the extinguisher. The fire extinguishing agent is a powdery blend of (a) 95 to 70% by weight of a high-purity boron oxide powder having a specified high $B_2O_3$ purity and a low water content and (b) 5 to 30% by weight of an inorganic powder of spherical particle configuration. Glass beads of a specified particle diameter and silica-alumina-based hollow microspheres serve as the inorganic powder.

2 Claims, No Drawings

METHOD FOR EXTINGUISHMENT OF METAL FIRE AND FIRE EXTINGUISHING AGENT THEREFOR

BACKGROUND OF THE INVENTION

The present invention relates to an efficient method for fire extinguishment of a burning metal and a fire extinguishing agent suitable therefor. More particularly, the invention relates to a method for fire extinguishment of a burning metal which can never be extinguished by pouring water or rather gains headway by pouring water and is hardly extinguishable by sprinkling a conventional fire extinguishing agent as well as to a fire extinguishing agent suitable therefor.

As is known, certain metals are combustible in air and are heavily dangerous when the metal takes fire in respect of the difficulty in extinguishment of the fire. Examples of such dangerous metals include magnesium, aluminum, zinc, titanium, zirconium, iron, rare-earth metals, e.g., neodymium, and the like in a powdery form as well as alkali metals such as sodium, potassium and the like irrespective of the form. The metals of the former group are combustible, especially, in a fine powdery form and, once the powder takes fire, the metal burns violently sometimes to cause serious explosion. When the metal powder is burning and heated at high temperatures, the metal readily reacts with water to produce explosive hydrogen gas. Therefore, pouring of water to a burning metal powder can never be a means of fire extinguishment and must be strictly avoided in order not to cause explosion of the hydrogen gas and the so-called steam explosion by which the metal powder is scattered around to badly spread the fire. Conventional fire extinguishing agents other than water such as carbon dioxide gas and Halons as well as powdery fire extinguishing agents, i.e. so-called dry chemicals, are also almost ineffective for the fire of metal powders. A means barely effective for extinguishment of fire of a burning metal powder is to sprinkle dry sand or a special powdery chemical or a dry powder such as sodium chloride, sodium carbonate and the like by which the fire may be suppressed to some extent if not completely extinguished. The use of such a dry powder is not advantageous in practice because a quite large amount of the powder must be sprinkled and the metal powder heated at high temperatures remains lastingly in the core portion of the powder pile in the form of a red-heated ember which must be kept as such sometimes for 30 to 60 minutes or even longer involving a danger of burning up again depending on the conditions. In addition, it is practically a difficult matter to stock a large amount of sand in an absolutely dry condition.

Alkali metals such as sodium and potassium are still more dangerous than the metal powders of the above mentioned class. These alkali metals, even at room temperature or not in a powdery form, readily and violently react with water to evolve a large quantity of heat to cause melting of the metal and produce hydrogen gas which spontaneously takes fire sometimes to cause explosion. Therefore, these alkali metals must be strictly kept away from contacting with water. Other known fire extinguishing agents are almost ineffective for the fire of alkali metals. Like the powders of the former class metals, a barely effective means for extinguishment of fire of an alkali metal is to completely cover up the burning site of the alkali metal with a large volume of dry sand or dry powder mentioned above to effect the suffocating effect for extinguishment taking a rather lengthy time.

The inventor previously has got an idea that such a metal fire may be efficiently extinguished by sprinkling a powder of high-purity boron oxide almost free from water and conducted extensive experiments by using a boron oxide powder or a blend of a boron oxide powder and a mineral powder such as talc, clay, mica and the like to obtain a promising result. A problem in such a powder or powder blend is that coalition or caking of the particles takes place during storage of the powder to cause a difficulty in sprinkling of the powder. When, for example, a fire extinguisher is filled with the powder and used to eject the powder under a gaseous pressure by opening the valve after storage for a length of time, the ejectability of the powder is gradually decreased in the lapse of time for storage so as to leave a considerable portion of the powder unejected in the fire extinguisher as a consequence of the decreased flowability of the powder due to caking of the powder.

SUMMARY OF THE INVENTION

The present invention accordingly has an object to provide a novel efficient method for extinguishment of fire on a metal, such as magnesium, aluminum, zinc, titanium, zirconium, iron and rare-earth metals, e.g., neodymium, in particular, in a powdery form as well as alkali metals, e.g., sodium and potassium, and a fire extinguishing agent suitable therefor without the above described problems and disadvantages in the prior art methods and fire extinguishing agents.

Thus, the fire extinguishing agent of the invention is a powdery blend comprising:

(a) a powder of boron oxide having a particle diameter in the range from 5 to 1000 μm, of which the content of $B_2O_3$ is at least 90% by weight and the content of water does not exceed 2% by weight; and (b) inorganic particles having a spherical particle configuration, which are either (b—1) glass beads having a particle diameter in the range from 5 to 200 μm and rendered hydrophobic on the surface, or (b—2) hollow microspheres of silica·alumina having a particle diameter in the range from 50 to 600 μm.

In particular, it is preferable that the water content in the boron oxide powder as the component (a) is 0.5% by weight or smaller and the blending proportion of the components (a) and (b) is in the range from 95:5 to 70:30 by weight.

The method of the present invention for extinguishment of a metal fire accordingly comprises sprinkling the above defined powdery fire extinguishing agent over and to cover the burning site of the metal.

DETAILED DESCRIPTION OF THE PREFERRED EMBODIMENTS

As is described above, the inventive fire extinguishing agent is a binary blend of a boron oxide powder as the component (a) and an inorganic powder of spherical particles as the component (b) which serves to prevent the boron oxide powder as the principal ingredient from coalition or caking and to enhance the flowability of the powder.

The boron oxide powder as the principal ingredient in the inventive fire extinguishing agent should be so pure as to contain at least 90% by weight of $B_2O_3$ and no larger than 2% by weight or, preferably, 0.5% by weight of water. The reagent-grade boron oxide available on the market contains about 85% by weight of $B_2O_3$ and about 10% by weight of water forming boric acid with the boron oxide. Boron oxide powders of such a grade cannot be used as the component (a) in the inventive fire extinguishing agent. Further, commercially available boron oxide of analytical grade contains about 97% by weight of $B_2O_3$ and about 2% by weight of water and can be used as the component (a) in the inventive fire extinguishing agent though not very satisfactory. A boron oxide powder quite satisfactory as the component (a) in the inventive fire extinguishing agent can be obtained by a heat treatment of the above mentioned analytical-grade boron oxide powder, for example, at 160° C. for about 2 hours so as to decrease the water content therein to 0.5% by weight or lower.

The boron oxide powder should have a particle diameter in the range from 5 to 1000 μm. In particular, a boron oxide powder having a particle diameter in the range from 5 to 200 μm is suitable as a filling of fire extinguishers of the cartridge type or stored-pressure type while a powder having a particle diameter in the range from 200 to 1000 μm is suitable for sprinkling using shovels, buckets and the like. A fine boron oxide powder having a particle diameter smaller than 5 μm cannnot be used in the inventive fire extinguishing agent because too fine boron oxide particles are readily blown and scattered away by the violently rising flame not to effectively cover up the burning site. When the boron oxide powder is too coarse, on the other hand, an unduly long time would be taken before the boron oxide particles are melted to form an air-shielding layer in addition to the problem that a somewhat larger amount of the powder must be sprinkled to form a covering powder layer having a sufficiently high suffocating effect.

The component (b) in the inventive fire extinguishing agent to be blended with the above described boron oxide powder is an inorganic powder of spherical particles which can be either (b—1) glass beads or (b—2) hollow microspheres of silica·alumina. These spherical particles of the inorganic powder should be surface-treated with a suitable water-repellent agent such as a silicone oil so as to be rendered hydrophobic or water-repellent since otherwise the particles absorb moisture and lose flowability when they are kept standing in the atmospheric air.

Typically, the spherical glass beads suitable for use in the inventive fire extinguishing agent have a particle diameter in the range from 5 to 200 μm and an apparent density of 2.5 g/cm$^3$. Chemically, the glass of the beads contains 72% of $SiO_2$, 14% of $Al_2O_3$, 13.5% of $Na_2O$ and $K_2O$ as a total, 9% of CaO and 3.5% of MgO. When properly surface-treated with a silicone oil to be rendered hydrophobic, the glass beads have an angle of repose in the range from 24° to 28°. Hollow glass spheres can also be used as a substitute for the above described glass beads.

The spherical glass beads must be surface-treated to be imparted with hydrophobicity or water repellency. The surface treatment can be performed, for example, by dipping the glass beads in a suitable organosilicon compound including organochlorosilane compounds, e.g., methyl chlorosilanes and derivatives thereof, methyl hydrogen polysiloxanes or derivatives thereof and the like as an organic solution and drying the beads in air. Instead of the hydrophobic treatment of the boron oxide powder, glass beads and/or hollow microspheres of silica·alumina, a similar improvement for the flowability of the powder blend can be obtained by blending the powder blend with a small amount, e.g., 1 to 2% by weight, of a finely divided silica powder having an average particle diameter of 90 to 130 nm and rendered hydrophobic on the surface.

The blending proportion of the boron oxide powder and the spherical glass beads should be in the range from 95:5 to 70:30 by weight. When the powder blend as the inventive fire extinguishing agent is sprinkled over a burning metal, the air-shielding crust layer formed after extinguishment may have a high mechanical strength as compared with the layer formed from boron oxide alone. While the particles of the boron oxide powder have a polyhedral particle configuration with inherently poor flowability which is even further decreased when the powder is kept in a vessel for a long period of time, the stability in the flowability of the powder can be greatly improved by blending the boron oxide powder with glass beads having a spherical particle configuration and a very small angle of repose as is mentioned above.

Alternatively, hollow microspheres of silica·alumina can be used as the component (b) in the inventive fire extinguishing agent in place of the glass beads which can be prepared by subjecting naturally occurring and refined volcanic glass particles to a heat treatment with rapid temperature increase to cause softening of the particles and vaporization and expansion of the structural water. Typically, the silica·alumina-based hollow microspheres have an apparent density of 0.15 to 0.20 g/cm$^3$ and a particle diameter in the range from 50 to 600 μm. Chemically, the silica·alumina-based hollow microspheres are composed of 76% of $SiO_2$, 14% of $Al_2O_3$ and 10% of other oxides and have a melting point of about 1200° C. The silica·alumina-based hollow microspheres have an angle of repose in the range from 30° to 32°.

The blending proportion of the boron oxide powder and the silica·alumina-based hollow microspheres should be in the range from 95:5 to 70:30 by weight in order to prevent the powder blend from coalition or caking and to improve the flowability of the powder blend.

In the following, the fire-extinguishing method and the fire extinguishing agent of the invention are described in more detail by way of examples.

EXAMPLE 1.

A boron oxide powder of a polyhedral particle configuration having an average particle diameter of 60 μm, apparent density of 1.15 g/cm$^3$ and angle of repose of 43.2° and containing 98% by weight of $B_2O_3$ and 0.5% by weight of water was blended with (1) glass beads after a hydrophobic treatment having an average particle diameter of 45 μm, apparent density of 1.40 g/cm$^3$ and angle of repose of 24.6°, (2) silica·alumina-based hollow microspheres having an average particle diameter of 200 μm, apparent density of 0.18 g/cm$^3$ and angle of repose of 31.0° or (3) a combination of these two kinds of inorganic powders in blending proportions of (a) 85:15, (b) 90:10 and (c) 85:10:5, respectively, by weight. These powder blends are referred to as the blends A, B and C, respectively, hereinafter.

Table 1 below shows the overall apparent density and angle of repose of these three blends A, B and C. For comparative purpose, Table 1 also shows the corresponding values of further powdery blends D and E which were a 90:10 by weight blend of the boron oxide powder and talc of an irregular particle configuration having an average particle diameter of 22 μm and a 93:7 by weight blend of the boron oxide powder and mica of a flaky particle configuration having an average flake diameter of 30 μm, respectively.

TABLE 1

| Blend | Overall apparent density, g/cm$^3$ | Angle of repose, degrees |
|---|---|---|
| A | 1.18 | 36.0 |
| B | 0.80 | 39.8 |
| C | 0.89 | 39.7 |
| D | 1.17 | 44.5 |
| E | 1.12 | 43.8 |

Generally speaking, powdery fire extinguishing agents are imparted with higher flowability when the apparent density thereof is smaller. Further, a smaller angle of repose means a smaller tendency toward caking or coalition along with an increase in the flowability. As to the particle configuration, the tendency of a powder toward caking is smaller when the particles have a configuration closer to a true sphere.

As is clear from the data for the blends D and E in Table 1, the angle of repose of a boron oxide powder was almost unchanged or rather slightly increased by the admixture of an inorganic powder having an irregular or flaky particle configuration. The apparent density of the powder blend is also about the same as the boron oxide powder per se. Therefore, only little improvement could be obtained in the flowability of these comparative powder blends which also exhibited a tendency toward caking in the lapse of time for storage.

In contrast thereto, the powder blend according to the invention had a remarkably decreased angle of repose with improved flowability as a consequence of the admixture of the boron oxide powder with an inorganic powder of a spherical particle configuration along with disappearance of caking. In particular, the overall apparent density of the powder blend could be remarkably decreased by using the silica-alumina-based hollow microspheres as the inorganic powder also contributing to the improvement of the flowability of the powder blend.

EXAMPLE 2.

The powder blends A, B, C and D prepared in Example 1 as well as the boron oxide powder as such were used as a filling of a portable fire extinguisher. Thus, a portable fire extinguisher was filled with 5.0 kg of one of the powders or powder blends and pressurized with nitrogen gas to have a pressure of 9.5 kg/cm$^2$ and the thus powder-filled extinguishers were stored at room temperature for up to 12 months. Immediately after filling and periodically during the storage period, the valve of the extinguisher was opened one by one to eject the filling powder by the nitrogen gas pressure so as to determine the amount of the powder or powder blend left unejected in the extinguisher, from which the amount of the ejected powder or powder blend was determined. The results are shown in Table 2 below.

TABLE 2

| Powder | Ejected powder, %, after storage for (as filled) | 1 month | 3 months | 6 months | 12 months |
|---|---|---|---|---|---|
| A | 90.8 | 90.5 | 90.3 | 90.5 | 90.4 |
| B | 92.0 | 91.5 | 91.6 | 91.3 | 91.5 |

TABLE 2-continued

| Powder | Ejected powder, %, after storage for (as filled) | 1 month | 3 months | 6 months | 12 months |
|---|---|---|---|---|---|
| C | 91.5 | 90.8 | 91.0 | 90.9 | 90.8 |
| D | 91.5 | 90.3 | 88.3 | 83.0 | 80.6 |
| Boron oxide | 92.0 | 88.7 | 65.6 | 45.8 | 40.3 |

The boron oxide powder used in the above described tests contained at least 98% by weight of $B_2O_3$ and less than 0.5% by weight of water and had a particle size distribution in the range from 5 to 200 μm. The glass beads and the silica-alumina hollow microspheres were respectively those described before as a typical product. As is understood from the above given results of the test, the inventive fire extinguishing agent is very stable in respect of the ejectability from the fire extinguisher as compared with the boron oxide powder alone or a blend of the boron oxide powder with talc over a long period of storage.

EXAMPLE 3.

A 20 g heap of magnesium powder on the center portion of a stainless steel-made dish of 30 cm diameter was set on fire using a gas torch. When the fire has spread allover the surface of the powder heap, the powder was shuffled so that the powder burnt violently raising white bright flames with evolution of intense heat. Then, the fire extinguishing test was conducted by sprinkling either one of the powders A,B,C and D and the boron oxide powder used in the preceding examples in amounts of 19 g, 15 g, 19 g, 22 g and 18 g, respectively. The effectiveness in fire extinguishment was good in each of the tests using these five kinds of powders with efficient suppression of the flames and without smoking and embers left after extinguishment except that a small noise was heard in the sprinkling of the powders C and D. Following are the remarks on the surface condition after extinguishment.

Powder A: a hard crust layer formed, complete melting indicated at the high-temperature portion Powder B: a hard crust layer formed, granular appearance at the high-temperature portion Powder C: a very hard crust layer formed, granular appearance at the high-temperature portion Powder D: a somewhat brittle and granular crust layer formed at the high-temperature portion Boron oxide powder: a strong, glassy crust layer formed at the high-temperature portion As is understood from the above given results of the fire extinguishing tests, the admixture of the inorganic powder of spherical particles with the boron oxide powder does not cause any decrease in the fire extinguishing effect of the powder. Although the above described tests were conducted by using a magnesium powder, substantially the same good results of fire extinguishment can be obtained even in the extinguishment of fire on a powder of zinc, titanium, zirconium, iron, rare-earths and other metals.

What is claimed is:

1. A powdery fire extinguishing agent which is a blend comprising:

(a) from 95% to 70% by weight of a powder of boron oxide having a particle diameter in the range from 5 to 1000 μm, of which the content of $B_2O_3$ is at least 90% by weight and the content of water does not exceed 2% by weight; and (b) from 5% to 30% weight of an inorganic powder of particles having a spherical particle configuration, selected from the group consisting of:

(b—1) glass beads having a particle diameter in the range from 5 to 200 μm and rendered hydrophobic on the surface; and (b—2) hollow microspheres of silica alumina having a particle diameter in the range from 50 to 600 μm.

2. A method for the extinguishment of fire of a burning metal which comprises sprinkling, over the burning metal, a powdery fire extinguishing agent which is a blend comprising:

(a) from 95% to 70% by weight of a powder of boron oxide having a particle diameter in the range from 5 to 1000 μm, of which the content of $B_2O_3$ is at least 90% by weight and the content of water does not exceed 2% by weight; and (b) from 5% to 30% by weight of an inorganic powder of particles having a spherical particle configuration, selected from the group consisting of:

(b—1) glass beads having a particle diameter in the range from 5 to 200 μm and rendered hydrophobic on the surface; and (b—2) hollow microspheres of silica alumina having a particle diameter in the range from 50 to 600 μm.

* * * * *